US006322646B1

(12) United States Patent
Chakrabarti et al.

(10) Patent No.: US 6,322,646 B1
(45) Date of Patent: Nov. 27, 2001

(54) METHOD FOR MAKING A SUPERPLASTICALLY-FORMABLE AL-MG PRODUCT

(75) Inventors: Dhruba J. Chakrabarti, Export; Roger D. Doherty, Wynnewood, both of PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/592,513

(22) Filed: Jun. 12, 2000

Related U.S. Application Data

(60) Continuation-in-part of application No. 09/176,133, filed on Oct. 21, 1998, now abandoned, which is a division of application No. 08/919,869, filed on Aug. 28, 1997, now Pat. No. 6,063,210.

(51) Int. Cl.[7] ..... C22F 1/047
(52) U.S. Cl. ..... 148/564; 148/693; 148/697
(58) Field of Search ..... 148/564, 693, 148/694, 697

(56) References Cited

U.S. PATENT DOCUMENTS

| | | | |
|---|---|---|---|
| 3,226,267 | 12/1965 | Foerster | 148/11.5 |
| 3,876,474 | 4/1975 | Watts et al. | 148/32 |
| 4,531,977 | 7/1985 | Mishima et al. | 148/2 |
| 4,618,382 | 10/1986 | Miyagi et al. | 148/415 |
| 4,645,543 | 2/1987 | Watanabe et al. | 148/2 |
| 4,874,578 | 10/1989 | Homberger et al. | 420/541 |
| 4,876,185 | 10/1989 | Matsumoto et al. | 430/580 |
| 5,181,969 | 1/1993 | Komatsubara et al. | 148/552 |
| 5,332,456 | 7/1994 | Masumoto et al. | 148/564 |
| 5,405,462 | 4/1995 | Masumoto et al. | 148/564 |
| 5,540,791 | 7/1996 | Matsuo et al. | 148/549 |
| 5,571,347 | 11/1996 | Bergsma | 148/550 |
| 5,772,804 * | 6/1998 | Brown | 148/564 |
| 6,063,210 * | 5/2000 | Chakrabarti et al. | 148/415 |

OTHER PUBLICATIONS

"Solute Enhanced Strain Hardening of Aluminum Alloys"; Aluminum Alloys for Packaging, The Minerals, Metals & Materials Society, ©1993; pp. 347–368.

* cited by examiner

*Primary Examiner*—George Wyszomierski
(74) *Attorney, Agent, or Firm*—Gary P. Topolosky

(57) ABSTRACT

A method for making a superplastically formable, aluminum alloy product which consists essentially of: about 2–3.8 wt. % magnesium; at least one dispersoid-forming element selected from the group consisting of: up to about 1.6 wt. % manganese, up to about 0.2 wt. % zirconium, and up to about 0.3 w. % chromium; at least one nucleation-enhancing element for recrystallization selected from: about 0.11–1.0 wt. % silicon, up to about 1.5 wt. % copper, and combinations thereof. Said alloy product has greater than about 300% elongation at a strain rate of about 0.0001–0.003/sec and a superplastic forming temperature between about 1000–1100° F. due, in part to the preferred thermomechanical processing steps applied to its intermediate plate or slab product forms.

23 Claims, 5 Drawing Sheets

METHOD FOR MAKING A SUPERPLASTICALLY-FORMABLE AL-MG PRODUCT

CROSS-REFERENCE TO RELATED APPLICATIONS

This application is a continuation-in-part of application Ser. No. 09/176,133, filed on Oct. 21, 1998, abandoned which is a division of application Ser. No. 08/919,869, filed on Aug. 28, 1997, now U.S. Pat. No. 6,063,210, the disclosures of which are all fully incorporated by reference herein.

BACKGROUND OF THE INVENTION

1. Field of the Invention

This invention relates to the field of superplastically formable aluminum alloys, and more particularly to means for imparting superplastic formability to aluminum alloys with relatively lower magnesium concentrations, i.e., those with about 4 wt. % magnesium or less. The invention further relates to an improved sheet product made from said alloys, said sheet product having improved corrosion resistance thereby making it more suitable for use in numerous applications, especially those in the automotive field.

2. Technology Review

Numerous approaches are known for enhancing superplastic formability. Some are directed to manipulations in the superplastic forming operation to enhance said operation or alleviate problems associated with it largely by controlling the flow of metal during forming. Representative examples of such manipulations are shown in U.S. Pat. Nos. 3,997,369, 4,045,986, 4,181,000 and 4,516,419. Another approach is directed to the metal to be superplastically formed. It has long been recognized that fine grain size enhances forming operations, including superplastic forming. Some efforts to achieve fine grain size are shown in U.S. Pat. Nos. 3,847,681 and 4,092,181. More recently, U.S. Pat. No. 5,055,257 taught adding scandium and zirconium to certain aluminum alloys for achieving SPF properties in 7050-type alloy.

There are several known ways for achieving superplastic formability in aluminum alloys with relatively higher magnesium contents, i.e. generally above 4 wt. % Mg. For Al sheet products containing about 4.5 wt. % or higher Mg, even up to about 10% Mg, the Zr, Cr and/or Mn dispersoids that are usually present develop superplastic forming (SPF) capabilities with elongations of about 400–550% at moderately fast strain rates of about $2\times10^{-3}$/sec or more when subjected to certain thermomechanical process (or "TMP") combinations. The latter rates are similar to the relatively fast strain rates available for a commercial SPF aluminum alloy sold by Superform under the mark Supral®.

Al alloys with magnesium contents of about 3 wt. % have superior corrosion resistance compared to their higher Mg (4.5 wt. % and above) counterparts, thus making lower magnesium-containing, aluminum alloys attractive for many automotive part applications, especially when such parts can be made by superplastic forming ("SPF") to achieve part consolidation. When subjected to identical TMP conditions as those described above for higher Mg alloys, however, an Al-3% Mg alloy resulted in a maximum elongation of only about 208%. There is a current need to develop an SPF Al—Mg for possible automotive parts consolidations. Most efforts have centered around 4.5% Mg compositions because of automakers' and researchers' past familiarity with 5083 and 5182 alloy performance, an SPF alloy with only about 3% Mg would be preferred in spite of its somewhat reduced strength, since such lower Mg alloys are less susceptible to intergranular corrosion when exposed to paint bake temperatures unlike their Al-4.5 Mg counterparts. Such a development could provide a differentiated product for possible use in both inner part and outer panel automotive applications. Said products would have superior corrosion resistance coupled with high SPF formability. This invention addresses recent efforts to achieve good SPF elongations, in excess of about 400%, and more preferably 500% or higher, for about 88% cold rolled sheet at about 1050° F. using a moderately high strain rate of about 0.001/sec. The results obtained herein compare favorably with SPF results reported in the literature for the 4.5% Mg-based 5083 and 5182 aluminum alloys favored by today's automotive manufacturers and designers. It is believed that the same procedures described below for a new Al-3% Mg SPF product could also enhance the performance of higher Mg-containing alloys, including Al-4.5% Mg alloys.

SUMMARY OF THE INVENTION

It is a principal objective of this invention to provide a relatively lower Mg, aluminum-based alloy with superplastic formability, and more preferably, with improved corrosion resistance as well. It is another main objective to provide a method for imparting superplastic formability to a greater range of Al alloys containing less than about 6 wt. % Mg, and more preferably, less than about 4 wt. % magnesium. It is another main objective herein to provide for automotive sheet manufacturers, an improved product and method for exploiting the superplastic formability of lower Mg, aluminum alloys. These, and other objectives are achieved with a superplastically formable, aluminum alloy product which consists essentially of: about 2–3.8 wt. % magnesium; at least one dispersoid-forming element selected from the group consisting of: up to about 1.6 wt. % manganese, up to about 0.2 wt. % zirconium, and up to about 0.3 w. % chromium; at least one recrystallization nucleation-enhancing element selected from: about 0.11–1.0 wt. % silicon and/or up to about 1.5 wt. % copper or more preferably about 0.8% or less copper. Said alloy product has greater than about 225% elongation at a strain rate of about 0.0001–0.003/sec and a superplastic forming temperature between about 950–1135° F. due, in part, to the preferred thermomechanical processing steps applied thereto. A related method of manufacture is also disclosed herein.

BRIEF DESCRIPTION OF THE DRAWINGS

Further features, objectives and advantages of this invention will be made clearer from the following detailed description of preferred embodiments made with reference to the accompanying charts, drawings and micrographs in which:

(FIG. 4*a*) versus 1050° F. (FIG. 4B) and a strain rate of 0.001/sec.;

DETAILED DESCRIPTION OF PREFERRED EMBODIMENTS

Figure 1:
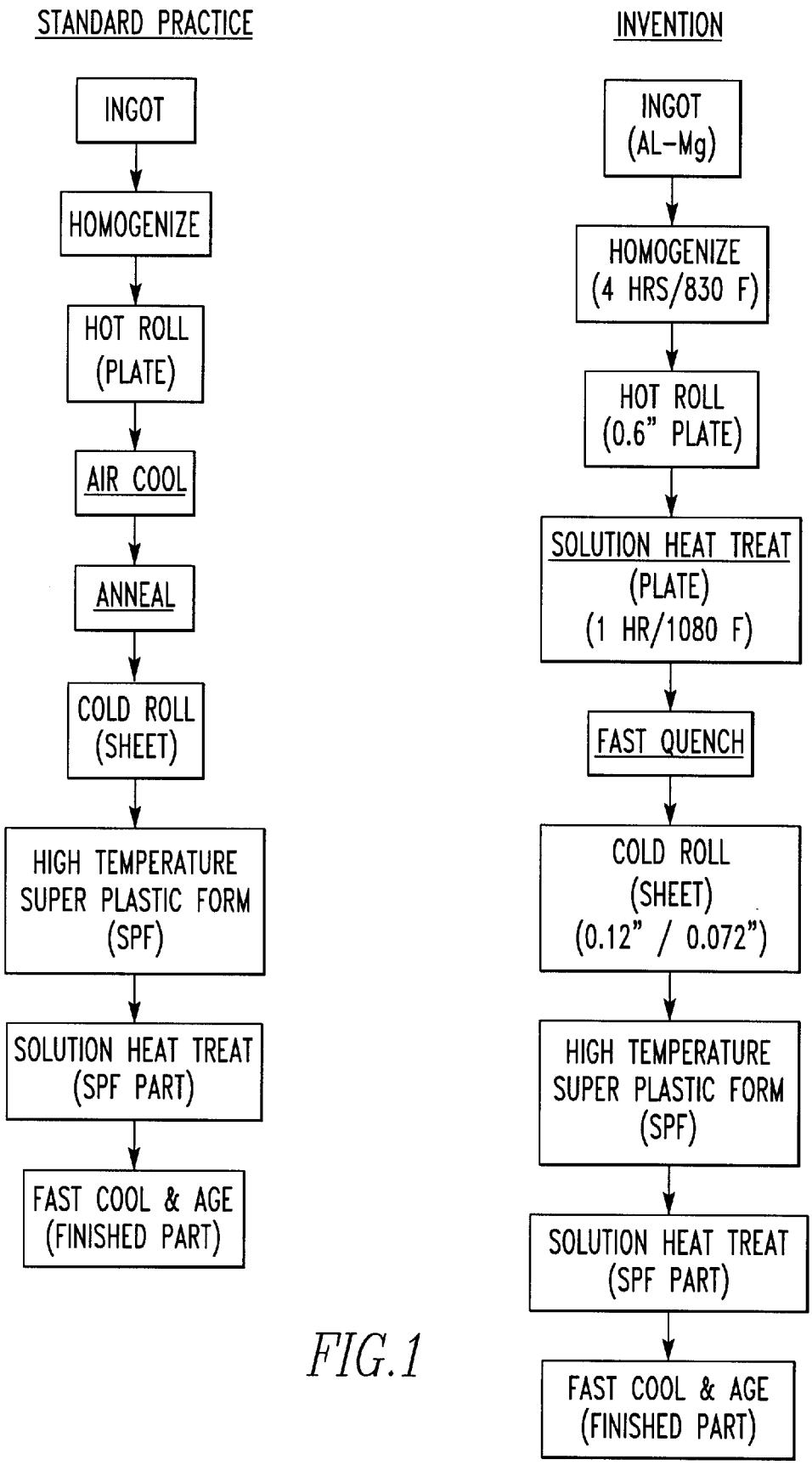
FIG. 1 is a flowchart comparing standard manufacturing process steps (left side) versus one preferred process according to the invention.

For any description of preferred alloy compositions, all references to percentages are by weight percent (wt. %) unless otherwise indicated.

When referring to any numerical range of values, such ranges are understood to include each and every number and/or fraction between the stated range minimum and maximum. A range of about 2–3.8 wt. % magnesium for example, would expressly include all intermediate values of about 2.1, 2.2, 2.3 and 2.5 wt. %, all the way up to and including 3.75, 3.77 and 3.79 wt. % Mg. The same applies to every other elemental and/or numerical property/processing range set forth herein.

As used herein, the term "substantially-free" means having no significant amount of that component purposefully added to the alloy composition, it being understood that trace amounts of incidental elements and/or impurities may find their way into a desired end product. For example, a substantially iron-free alloy might contain less than about 0.3% Fe, or less than about 0.1% Fe on a more preferred basis, due to contamination from incidental additives or through contact with certain processing and/or holding equipment. It is to be understood that the alloy composition of this invention is also generally free of any elemental components not expressly mentioned hereinabove. Particularly, this invention is free of components X, Y and Z even though it does not expressly state every single component which is absent from its preferred formulations. Furthermore, all corrosion-resistant embodiments of this present invention are substantially copper-free although the invention could be applied to Cu-containing alloys as needed.

As used herein, the term "superplastic" describes the forming of complex shapes from metals, especially aluminum alloys herein, at elevated temperatures and specified strain rates utilizing the superplastic forming characteristics of the metal to avoid localized necking, cavitation, tearing and other complex shape-forming problems. Superplastic forming can and has been viewed as an accelerated form of high temperature creep and occurs much like sagging or creep forming. In the case of aluminum alloys, superplastic forming is normally performed at temperatures above 700° F., typically in the range of about 900 to 1000° F. or even higher. At these temperatures, the metal creeps and can be moved by shaping operations at relatively low stress levels, the stress at which metal starts to move easily or "flow" being referred to as the flow stress.

Superplastic forming is recognized as being able to produce intricate forms or shapes from sheet metal and offers the promise of cost savings through opportunity for parts consolidation. Superplastic-forming techniques, however, are themselves time-consuming in that like any form of creep forming, the metal flowing operation proceeds relatively slowly in comparison with high speed press forming. Substantial cost savings and benefits could be realized if a superplastically formed, aluminum alloy could be made to flow faster at a given temperature, or be superplastically formed at a lower temperature, or both, without localized necking, tearing or rupturing.

Fine grain size, a prerequisite for good SPF properties, is generally obtained by manipulating both nucleation and growth of recrystallized grains in the cold rolled (CR) sheets. Ideally, many nucleation centers to form many recrystallized grains coupled with sufficient pinning sources to prevent grain growth are prerequisites to obtain fine grains. Al-3 wt. % Mg alloys (in our example) utilize similar dispersoid additions as the 4.5 and higher Mg alloys and higher, for example 6 wt. % Mg, or even up to about 10 wt. % Mg. Thus, they have the requisite pinning centers to prevent grain growth. Nucleation wise though all the alloys had undergone identical deformation, it is likely that at the 3 wt. % Mg level the density of dislocation networks which increases with increasing Mg was inadequate, thus resulting in less development of nucleation sources for recrystallized grains. Thus, it appeared that the improved SPF performance of the Al-3 wt. % Mg alloy was intimately related to its ability to develop finer grains through the formation of more recrystallization nuclei made possible through some new approach.

The current invention attempts to overcome the low solute handicap in lower Mg-content, aluminum-based alloys. By incorporating Si (and/or Cu when corrosion is not a concern) into solid solution, the density of tangled dislocations could be increased during TMP to a level similar to that of higher Mg alloys or lower Mg alloys with other intentional solute additions like Zn, Cu, etc. This would then provide more nucleation centers for recrystallized grains. On a preferred basis, Si is added to Al-3 wt. % Mg alloys to its maximum solubility limit. However, the solubility of Si (and to an extent of Cu) is drastically reduced in aluminum alloys containing greater than 1 wt. % Mg. Thus, the amount of Si that could be added to an Al-3 wt. % Mg composition was 0.18% corresponding to the highest possible SHT temperature of 1080° F. per equilibrium diagram information. In addition, combinations of dispersoid formers Mn, Cr and/or Zr were added. On a preferred basis, the alloy product of this invention contains Zn, Cu and Mg levels that satisfy the following formulaic ratio:

$$\frac{(\%\ \mathrm{Zn} + \%\ \mathrm{Cu})}{\%\ \mathrm{Mg}} < 0.5$$

The final composition of a test, book mold ingot (2.0"× 10"×14") was: Mg: 3.13 wt. %; Si: 0.22 wt. %; Mn: 0.78 wt. %; Cr: 0.19 wt. %; Zr: 0.10 wt. %; Fe: 0.05 wt. %; Be: 0.0004 wt. %;, the balance aluminum. The scalped ingot was heated to 830° F. in 15 hours, soaked for 4 hours at 830° F., and hot rolled in four passes to a 0.6" finish gauge plate. The plate was then solution treated at 1080° F. for 1 hour, cold water quenched (CWQ) and cold rolled (in 10 passes) to an 80% reduction (or to 0.12") or, alternatively to an 88% reduction (0.072" gauge sheet).

SPF tests were performed on these sheet products by rapidly heating the samples in 15 minutes to SPF test temperatures of 1000 or 1050° F. Failure samples were then taken for metallographic examination of their grain structures. The actual SPF tests followed the normal procedures of first determining the strain rate sensitivity parameter (m) as a function of strain rate, and then determining the elongation at selected constant strain rates corresponding to the highest or optimized high "m" values. In this investigation, strain rates varied from 0.003 to 0.0003/sec and the corresponding "m" values from 0.35 to 0.45, respectively.

Another important aspect of this invention is the application of a drastic cooling rate, or quench, to the hot rolled plate or slab (prior to cold rolling). Preferably, this quench, which follows the first of two solution heat treatments (or "SHT") is accomplished via contact with a cold liquid medium, most preferably cold water. For the aforementioned alloy composition, that first SHT is optimized at or below about 1080° F. to retain solute supersaturation and take full advantage of same during subsequent cold rolling. This contrasts with a known standard practice (shown comparatively in accompanying FIG. 1) that uses air cooling of hot rolled plate followed by low temperature annealing and/or direct cold rolling. The additional solute retained by the preferably cold water quench (or "CWQ") of this invention leads to increased solute interaction effects due to Si. In subsequent stages, the much reduced solubility of Si at high Mg compositions was exploited to its best advantage. The excess Si formed many fine $Mg_2Si$ precipitates at lower temperature during the heat up for SPF. This resulted in added dispersoids effect which contributed to further grain growth control.

In FIG. 1, the differing steps between this invention and known standard practices have been underscored for further emphasis. Notably, the standard practice, with its lone SHT step, uses air cooling and annealing of a hot rolled plate product as compared to this method's use of a first SHT, rapid quench and cold roll, without any anneal, eventually followed by a second SHT and cooling. This invention also differs from known art by adding smaller amounts of Si and/or Cu than their other superplastic counterparts.

Figure 2A:
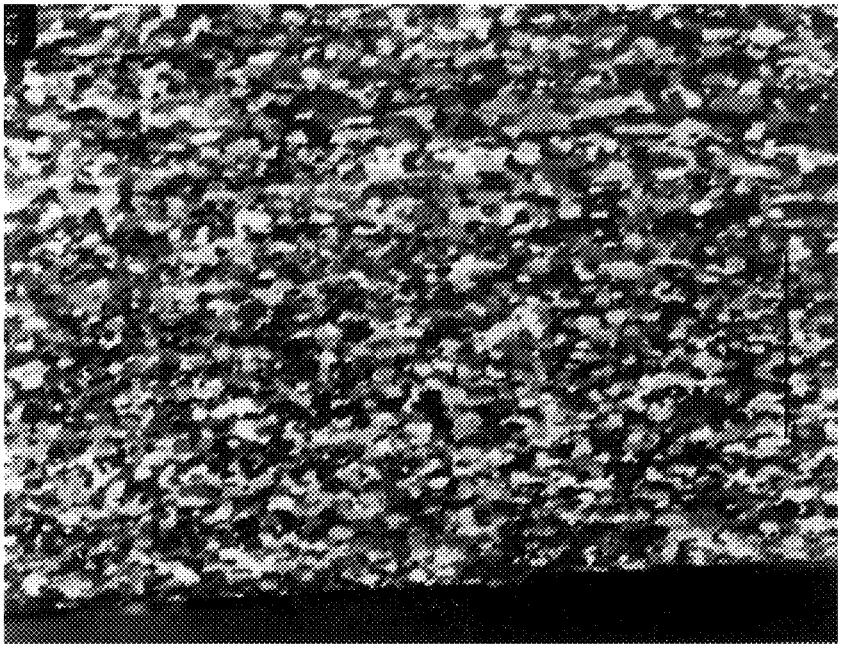
FIGS. 2A and 2B are polarized light optical micrographs (100× magnification) showing the grain structures of a 0.10 inch thick, superplastically formed sheet product according to this invention tested at 1000° F. and a strain rate of 0.0003/sec FIG. 2A being at Grip and FIG. 2B at Gauge, respectively.
Figure 2B:
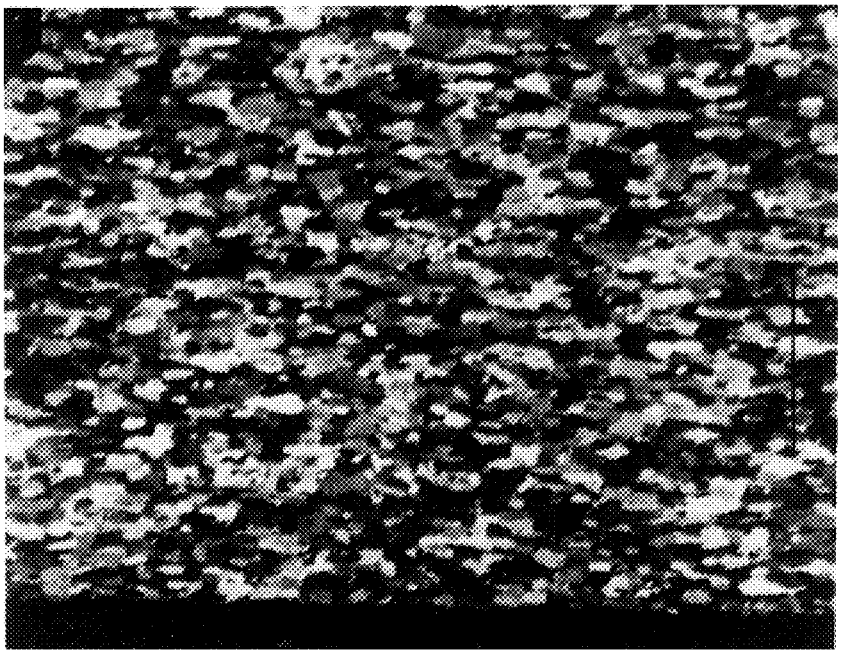

In the next several Figures, polarized light optical micrograph data illustrates several noteworthy changes in the microstructure that accompanied the progress of SPF in the preferred, lower Mg-containing alloys of this invention. FIGS. 2A and 2B show micrographs at Grip versus Gauge sections, respectively, for a 0.1" sample tested at 1000° F. and 0.0003/sec to indicate the effect of strain induced grain growth at Gauge. The Gauge was exposed to both high (SPF) temperature and strain while Grip to just high temperature exposure. Compared with FIG. 2A, the grain size in FIG. 2B appears somewhat coarser thereby indicating the effect of strain on the latter product sample.

Figure 3:
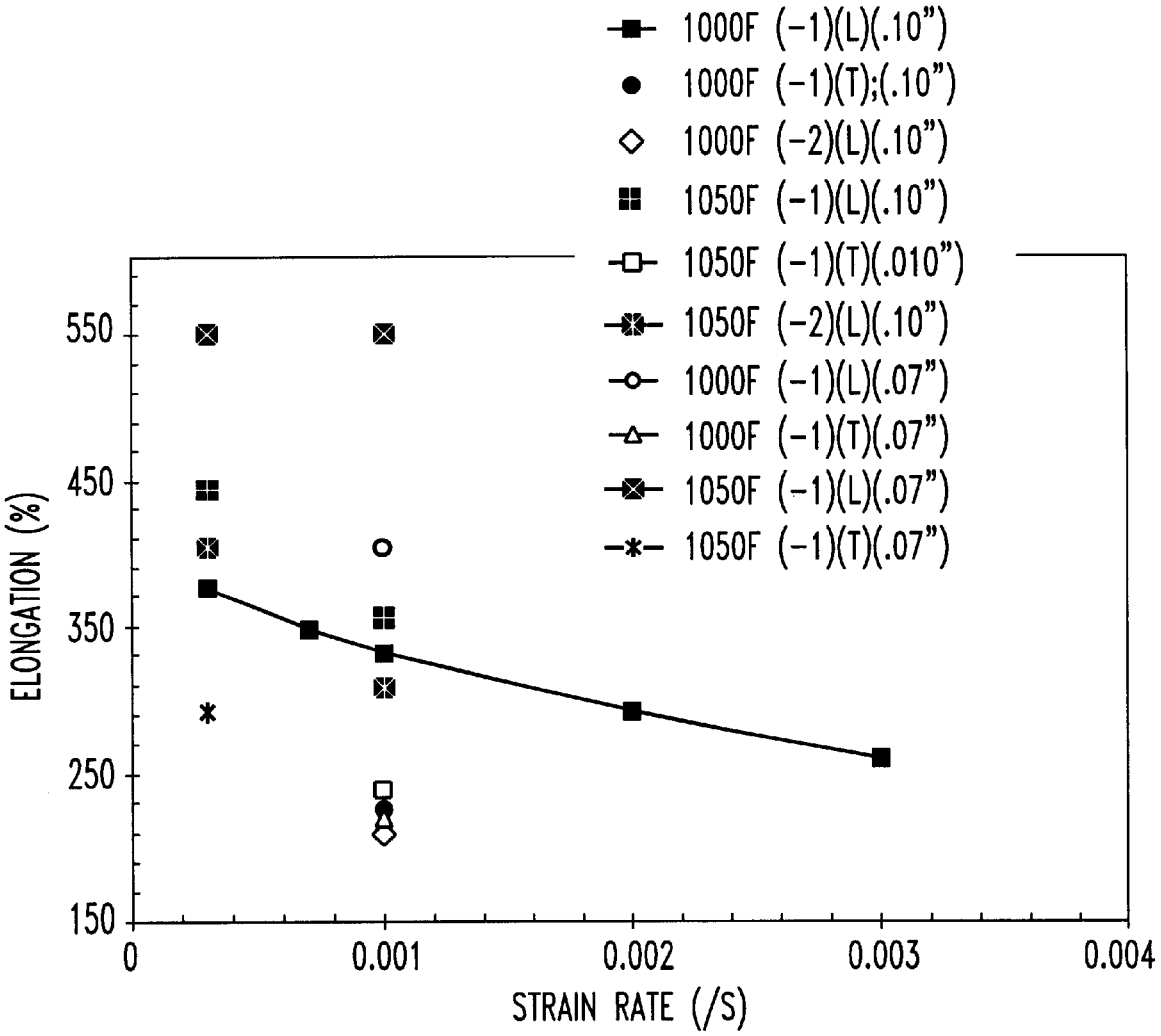
FIG. 3 is a chart showing the relative relationship of strain rate (x-axis) versus % elongation (y-axis) for one preferred alloy composition according to this invention.

FIG. 3 shows a composite plot of results in terms of SPF elongation (EL) versus strain rate (SR) at two different test temperatures (1000 and 1050° F.), and for two sheet gauges (0.1 and 0.07"), that corresponded to 80 and 88% cold roll reductions, respectively. Comparing these results with those observed for standard processed sheets (at the same 80% cold reduction and under identical test conditions of 1000° F. and 0.002/sec strain rates), longitudinal SPF elongation values were observed to increase to 292% from the standard value of 208% (not plotted in FIG. 3). Thus, the new process of this invention increased comparative elongations by nearly 40%!

General trends show an increase in elongation as strain rates decrease from about 0.002 to about 0.0003/sec (per the line connecting certain data points in accompanying FIG. 3). For example, elongation values went from 292% at 0.002/sec to 376% at 0.0003/sec for 80% cold rolled sheet at 1000° F. Since higher strain rates are generally more attractive to manufacturers, especially automotive sheet manufacturers, most of the SPF data in FIG. 3 was collected for a 0.001/sec strain rate.

FIG. 3 also shows the several higher SPF elongation values obtained in samples through further TMP optimization. Thus, at a strain rate of 0.001/sec, increasing the SPF test temperature from 1000 to 1050° F. increased elongation from 332 to 356%, while increasing the cold reduction from 80% to 88% increased elongation at 1000° F. from 332 to 404%. A sample of 0.072" gauge when tested at 1050° F., at either 0.001/sec or at 0.0003/sec, did not fail up to a 550% elongation limit imposed by the maximum setting of the cross head motion. Thus, the preferred new approaches of this invention, both Si additions and rapid quenching (preferably CWQ) of an intermediate slab or plate product prior to cold rolling, when combined with additional optimization measures (increased cold rolling and higher SPF test temperatures) succeeds in increasing overall SPF elongations for an Al-3 wt. % Mg alloy by more than 160% from its original 208% to greater than 550%.

In a comparative experiment, hot rolled plate samples were solution heat treated at a lower temperature, about 950° F. (below the solvus temperature), before being quenched to intentionally reduce the solubility of Si in the matrix. Such processing was predicted to correspondingly decrease the overall nucleation effect during deformation due to a reduced Si-Mg interaction effect. The SPF elongation results for these samples dropped from 332 to 216% at the aforesaid temperature and strain rate conditions consistent with this prediction.

Figure 4A:
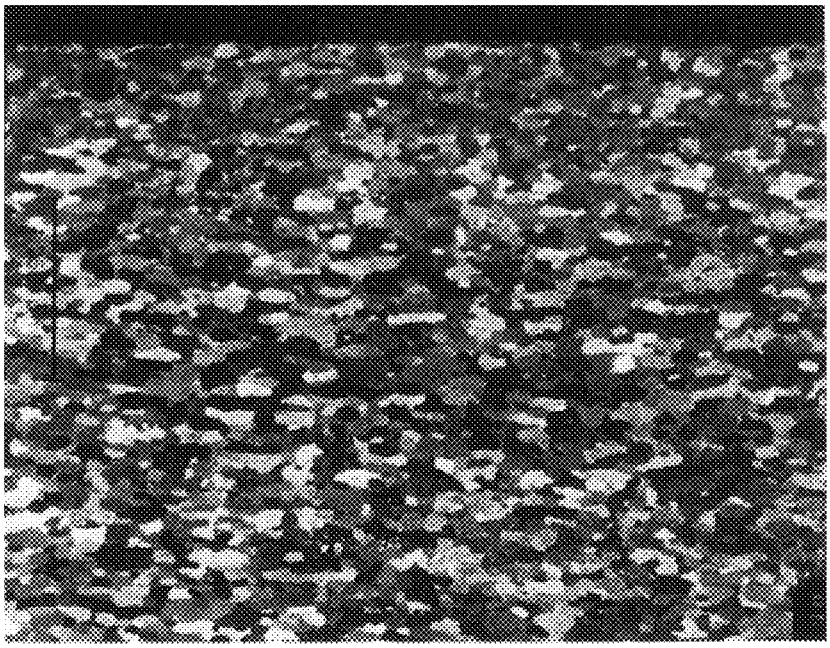
FIGS. 4A and 4B are polarized light optical micrographs (100× magnification) comparing the grain structures of a 0.10 inch thick, superplastically formed sheet product according to this invention tested at 1000° F.

Optical metallography of SPF-formed Al-3 wt. % Mg—Si samples in FIG. 4A show the presence of fine, uniformly recrystallized grains, thus meeting this invention's first objective of grain size refinement. The detailed SPF results are listed in Table 1 that follows.

TABLE 1

SPF Elongation Values as Functions of Strain Rate, Temperature and Sheet Gauge in an Al-3 Mg-0.2 Si Alloy According to the Invention

| Strain Rate | (/1000F(−1)(L)(.10") | (/1000F(−1) (T);).10") | (/1000F(−2) (L)(.10") |
|---|---|---|---|
| 0.0003 | 376 | | |
| 0.0007 | 348 | | |
| 0.001 | 332 | 224 | 216 |
| 0.002 | 292 | | |
| 0.003 | 260 | | |
| **Strain Rate** | **(/1050F(−1)(L)(.10")** | **(/1050F(−1) (T);(.10")** | **(/1050F(−2) (L)(.10")** |
| 0.0003 | 444 | | 404 |
| 0.0007 | | | |
| 0.001 | 356 | 236 | 308 |
| **Strain Rate** | **(/1000F(−1)(L)(.07")** | **(/1000F(−1) (T)(.07")** | |
| 0.0003 | | | |
| 0.0007 | | | |
| 0.001 | 404 | 224 | |
| **Strain Rate** | **(/1050F(−1)(L)(.07")** | **1050F(−1) (T)(.07")** | |
| 0.0003 | >550 | 292 | |
| 0.0007 | | | |
| 0.001 | >550 | | |

Figure 4B:
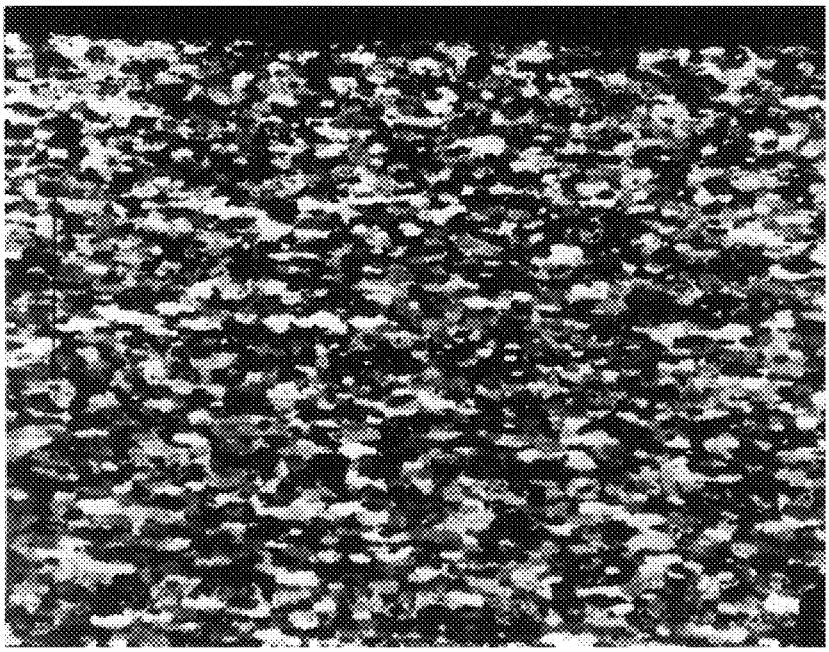

FIG. 4B shows the effect of temperature, where the gauge micrograph shows coarser grains for a test temperature of 1050° F. compared to the micrograph for 1000° F. in FIG. 4A (both using the strain rate 0.001/sec).

Figure 5A:
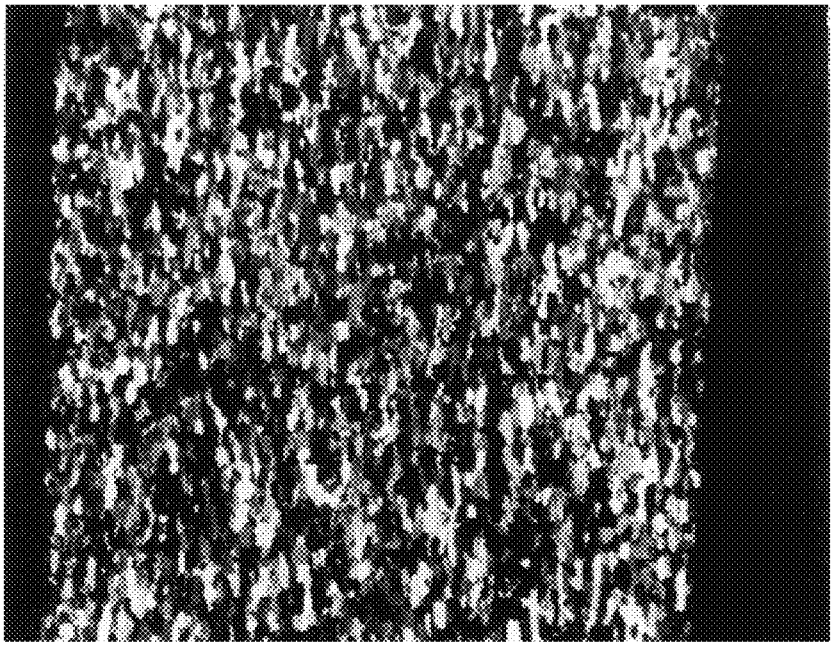
FIGS. 5A and 5B are polarized light optical micrographs (100× magnification) comparing the grain structures of a 0.07 inch thick, superplastically formed sheet product according to this invention tested at 1000° F. and a strain rate of 0.001/sec. to show the effect of cold rolling thereon, FIG. 5A being at Grip and FIG. 5B at Gauge, respectively.
Figure 5B:
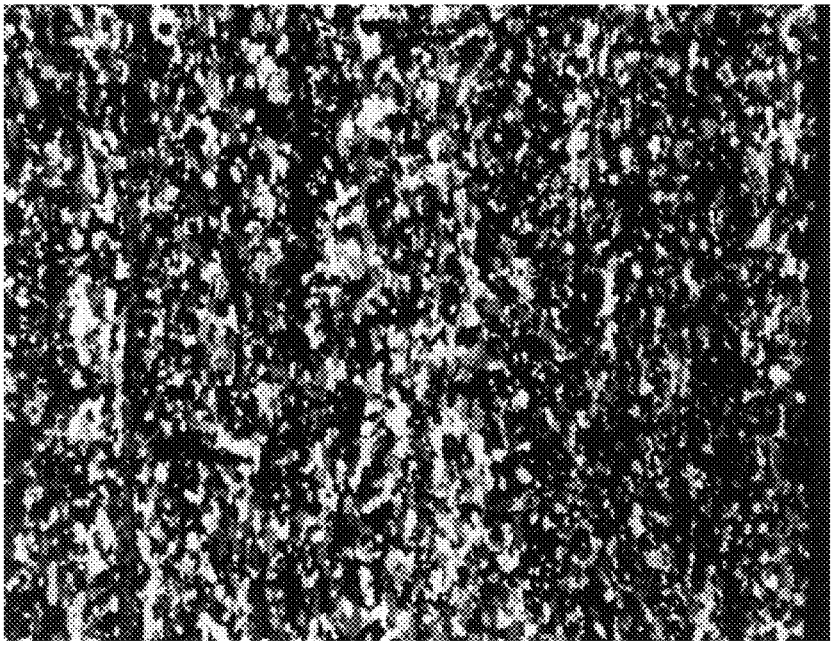

FIGS. 5A and 5B show the micrographs at Gauge and Grip, respectively, for the 0.07" gauge sheet pulled at 1000° F. and 0.001/sec, indicating that higher cold reduction resulted in further grain refinement commensurate with further increase in elongation, 404% compared to 332% for 0.10" sheets.

Because of the foregoing performance, it is believed that sheet product compositions processed according to this invention would achieve the desired SPF properties, with improved corrosion resistance performance and sufficient strength values as to warrant the manufacture of both inner and outer automotive structural sheet parts therefrom.

Having described the presently preferred embodiments, it is to be understood that the invention may be otherwise embodied by the scope of the claims appended hereto.

What is claimed is:

1. A method for making a superplastically formable, aluminum-based sheet product having greater than about 250% elongation at a strain rate of about 0.0001–0.003/sec and a temperature between about 950–1135° F., said method comprising the steps of:

(a) providing a hot rolled plate or slab made from an aluminum alloy containing: about 2.7–3.8 wt. % magnesium, at least one dispersoid-forming element selected from the group consisting of: up to about 1.6 wt. % manganese, up to about 0.2 wt. % zirconium, and up to about 0.3 w. % chromium; at least one nucleation-enhancing, recrystallization element selected from: about 0.11–1.0 wt. % silicon, up to about 1.5 wt. % copper, and combinations thereof, the balance incidental elements and impurities;

(b) solution heat treating the plate or slab at one or more temperatures between about 950–1135° F.; and (c) quenching the plate or slab at a drastic cooling rate prior to subsequent cold rolling to form said sheet product.

2. The method of claim 1 wherein step (b) includes solution heat treating the plate or slab at one or more temperatures between about 1000–1100° F.

3. The method of claim 1 wherein step (c) includes quenching the plate or slab through contact with a cold medium.

4. The method of claim 3 wherein step (c) includes cold water quenching.

5. The method of claim 3 wherein step (c) includes quenching via fast air cooling.

6. The method of claim 1 wherein the plate or slab is cold rolled to between about 75–90% reduction after step (c).

7. The method of claim 1 wherein said aluminum alloy contains up to about 3.2 wt. % magnesium.

8. The method of claim 1 wherein said aluminum alloy contains about 0.13–0.23 wt. % silicon.

9. The method of claim 1 wherein said aluminum alloy contains about 0.8 wt. % copper or less.

10. The method of claim 9 wherein said aluminum alloy is substantially copper-free.

11. The method of claim 1 wherein said sheet product has greater than about 300% elongation at said strain rate and superplastic forming temperature range.

12. The method of claim 11 wherein said sheet product has greater than about 400% elongation at said strain rate and superplastic forming temperature range.

13. The method of claim 12 wherein said sheet product has greater than about 500% elongation at said strain rate and superplastic forming temperature range.

14. A method for making a superplastically formable, sheet product from an aluminum alloy containing about 2–3.8 wt. % magnesium, and at least one dispersoid-forming element selected from the group consisting of: up to about 1.6 wt. % manganese, up to about 0.2 wt. % zirconium, and up to about 0.3 wt. % chromium; and about 0.11–1.0 wt. % silicon, said method comprising the steps of:

(a) hot rolling the alloy to form a plate or slab;

(b) solution heat treating the plate or slab at one or more temperatures between about 1000–100° F.;

(c) rapidly quenching said plate or slab;

(d) without any annealing, cold rolling said plate or slab to form a sheet product therefrom;

(e) subjecting said sheet product to high temperature superplastic forming;

(f) cooling said sheet product;

(g) solution heat treating said sheet product at one or more temperatures above the solvus temperature; and (h) cooling said sheet product.

15. The method of claim 14 wherein said aluminum alloy contains about 2.7–3.2 wt. % magnesium.

16. The method of claim 14 wherein said aluminum alloy contains about 0.13–0.23 wt. % silicon.

17. The method of claim 14 wherein step (c) includes quenching the plate or slab through contact with a cold medium.

18. The method of claim 17 wherein step (c) includes cold water quenching.

19. The method of claim 17 wherein step (c) includes quenching via fast air cooling.

20. The method of claim 14 wherein step (d) includes cold rolling the plate or slab to between about 75–90% reduction.

21. The method of claim 14 wherein said sheet product has greater than about 300% elongation at a strain rate of about 0.0001–0.003/sec and a temperature between about 950–1135° F.

22. The method of claim 21 wherein said sheet product has greater than about 400% elongation at said strain rate and superplastic forming temperature range.

23. The method of claim 22 wherein said sheet product has greater than about 500% elongation at said strain rate and superplastic forming temperature range.

* * * * *

UNITED STATES PATENT AND TRADEMARK OFFICE

CERTIFICATE OF CORRECTION

PATENT NO. : 6,322,646 B1
DATED : November 27, 2001
INVENTOR(S) : Dhruba J. Chakrabarti et al.

It is certified that error appears in the above-identified patent and that said Letters Patent is hereby corrected as shown below:

Column 8,
Line 21, insert -- 1100 F. -- delete "100 F.".

Signed and Sealed this

Twenty-fifth Day of October, 2005

JON W. DUDAS
*Director of the United States Patent and Trademark Office*